United States Patent [19]

Herman

[11] 4,391,601

[45] Jul. 5, 1983

[54] WRITING PARCHMENT AND METHODS FOR THE PRODUCTION THEREOF

[76] Inventor: Shmuel Y. Herman, 65 Hapisga St. Bayit Vegan, Jerusalem, Israel

[21] Appl. No.: 328,070

[22] Filed: Dec. 7, 1981

[30] Foreign Application Priority Data

Dec. 26, 1980 [IL] Israel ..... 61809

[51] Int. Cl.[3] ..... C14C 1/00

[52] U.S. Cl. ..... 8/94.15; 8/94.17; 8/118

[58] Field of Search ..... 8/94.15, 94.17, 118

[56] References Cited

U.S. PATENT DOCUMENTS 4,224,029 9/1980 Heinz ..... 8/94.15

*Primary Examiner*—A. Lionel Clingman

*Attorney, Agent, or Firm*—Norbert P. Holler

[57] ABSTRACT

The invention provides fine writing parchment made from the skins of turkeys. The invention also provides a process for preparing fine writing parchment from the skins of turkeys comprising liming, defatting, washing and stretching the skins.

8 Claims, No Drawings

WRITING PARCHMENT AND METHODS FOR THE PRODUCTION THEREOF

The present invention relates to a novel parchment and methods for the production thereof.

More particularly the present invention relates to a fine writing parchment obtained from a novel source.

As is shown and as described in many encyclopedias, such as, the World Book of Knowledge, parchment is a material made from the skins of sheep, goats, calves and other animals and is used mainly as a fine writing material for important documents.

Heretofore parchment was made by removing the hair or wool from the skin of the animal, and placing this skin in lime to rid it of its fat. The skin was then stretched on a frame, shaved with knives and scrapers and powdered chalk was rubbed on with pumice stone, to smooth and soften the skin.

Fine parchment is often called vellum and is made from the skins of calves, kids, and lambs. This high-quality parchment is used for important writings, such as, charters, university diplomas, wills as well as for the preparation of Mazuza and Tefillin scrolls.

Heavy parchment is made from the skins of donkeys, calves, wolves and goats and is usually used for drum-heads.

While papyrus, made from vegetable parts hammered and pressed into sheets, was the earliest paper, invented about 3000 B.C.E., leather and parchment were also used in early times for documents which would receive more handling because these materials were more sturdy and the British Museum even has a parchment scroll dating from about 1280 B.C.E.

Around 1100 C.E. paper-making techniques were imported from the Orient and paper began to replace parchment as the common writing material, however, it is known that the durability of ancient books which have survived is due to their having been rendered on parchment.

Today high quality parchment is used primarily for religious documents, such as, the writing of the portions of the Law in Tefillin and Mazuzot and for prestige documents as indicated above, such as, charters, diplomas and wills as well as prestige Bibles, invitations, etc.

As reported in the Encyclopedia Americana and as known in the industry, while writing parchment is produced from the skins of sheep, goats, etc., true fine writing vellum is made solely from the skins of young calves and for said purpose, it is necessary that the animal be not over six weeks old otherwise the skin is too stout for vellum. The younger the calf the finer the vellum and the most sought after vellum is that which is made from the skins of still-born calves which skins in fact are almost the sole medium used by scribes in Israel today for Tefillin and Mazuzot.

It will be realized from the above that the supply of fine writing vellum is extremely limited and does not meet the extensive demand therefor. Similarly, because of the market dynamics of supply and demand the price of vellum is extremely high thus also limiting its use.

Despite the widefelt need and demand for vellum and its known existence and use for thousands of years, to date, no one has suggested or produced a fine writing vellum from an alternative source other than the skins of calves, kids and lambs.

In consideration of the above, it has now been surprisingly discovered that turkey skins can be processed to produce a fine vellum-like writing parchment and the present invention is thus directed to fine writing parchment made from the skins of turkeys and methods for the production thereof.

While it might have been expected that the quills of the turkey feathers would leave holes and/or surface irregularities in the skin of the turkey which would render it unsuitable for the presently proposed use, it has been found that this is not the case and turkey skins prepared according to the present invention are of a texture and uniformity rivaling that of fine vellum.

The advantages of using turkey skins according to the present invention as described hereinafter are so numerous as to further emphasize the point that the non-use of said source to date evidences the fact that men of the art simply never considered turkey skins as a possible source of vellum.

Thus, as opposed to calves whose births are seasonal and still-born calves whose supply is even more limited, in Jerusalem alone there are slaughtered thousands of turkeys almost every day whose skins are considered as a third-grade waste meat product usually ground into chopped meat as a filler and, therefore, priced accordingly. Turkey skins also have the advantage of being hairless thus eliminating the need for a dehairing process and the turkey skins which are a waste by-product of the massive turkey shnitzel and chopped meat export industry are usually already substantially free of feathers when purchased for the presently proposed use with any remaining feathers simply falling off the skins during the further processing thereof as described hereinafter.

While the processing of turkey skins into fine, vellum-like parchment will now be described in connection with certain preferred embodiments in the following examples, it will be understood that it is not intended to limit the invention to these particular embodiments. Thus, the following examples which include preferred embodiments will only serve to illustrate the practice of this invention, it being understood that the particulars described are by way of example and for purposes of illustrative discussion of preferred embodiments of the present invention only and are presented in the cause of providing what is believed to be the most useful and readily understood description of processing procedures.

EXAMPLE 1

Four kilograms of turkey skins containing 20 usable skins was purchased from a Jerusalem slaughterhouse at a price equivalent to 80 U.S. cents. (20 cents a kilo, 4 cents a skin).

The skins which were substantially without feathers were placed in a lime bath for 48 hours in order to bring about the opening of skin pores, the loosening of fibre bundles and to strengthen the skin while retaining its flexibility. A defatting composition was then prepared in the form of a paste made from barium sulfate and water which paste was rubbed onto the skins to further remove fat adhering thereto. The thus treated skins were then washed with simple detergent and water to remove residual lime, paste and fat and the skins were then stretched on a stretching frame, scraped with a kinfe and treated with an opaquing or coloring agent, such as, chalk or dye to produce a fine vellum-like writing parchment.

EXAMPLE 2

Two kilograms of turkey skins containing 11 usable skins were purchased as in example 1. These skins however, after being examined for possible tears were pressed onto flat trays with the outer side of each respective skin pressed flat against a tray and the fatty inner side of each skin facing up. Said skins were then placed in a freezer for one hour after which said frozen skins were removed and most of the frozen upper layer of fat was sheared off from said skins by hand with the traditional knife having a semicircular blade without any damage to the lower skin layer. Of course once commercialized said process step can be carried out with a beaming machine equipped with a spiral bladed cylinder and already used in the hide industry.

After thawing the substantially defatted skins, said skins were then placed in a lime bath for 36 hours and the subsequent procedure of example 1 was repeated even though for several skins the amount of fat remaining after the shearing off thereof was so minute as to render the treatment with barium sulfate almost superfluous.

An added benefit of the above defatting method is that said cut off fat can then be resold as a meat filler thereby further lowering the price of the final product.

As readily apparent to those working in the industry, the time duration of the liming process can be varied from one to several days, e.g. from about 24 to 72 hours depending on the lime concentration and the use of accelerating agents, such as, sodium sulfide, dimethylamine, sulphydrate and cyanide salts. Similarly, deliming agents, such as, ammonium sulfate or chloride could be substituted into the above-described process.

It will, therefore, be evident to those skilled in the art that the invention is not limited to the details of the foregoing illustrative examples and that the present invention may be embodied in other specific forms without departing from the essential attributes thereof, and it is, therefore, desired that the present embodiments and examples be considered in all respects as illustrative and not restrictive, reference being made to the appended claims, rather than to the foregoing description, and all changes which come with the meaning and range of equivalency of the claims are, therefore, intended to be embraced therein.

What is claimed is:

1. Fine writing parchment made from the skins of turkeys.

2. A process for preparing fine writing parchment from the skin of turkeys comprising liming, defatting, washing and stretching said skins.

3. A process according to claim 2 wherein said liming is carried out for a period of 24–72 hours.

4. A process according to claim 2 wherein accelerating agents are added to the lime solution.

5. A process according to claim 2 wherein said skins are defatted with barium sulfate.

6. A process according to claim 2 wherein before liming said skins are flattened, frozen and the frozen fat is cut off therefrom.

7. A process according to claim 2 wherein an opaquing agent is added to said skins.

8. Fine, vellum-like writing parchment according to claim 1 whenever made from limed, defatted, washed and stretched turkey skins.

* * * * *